US007097743B2

(12) United States Patent
Krebber et al.

(10) Patent No.: US 7,097,743 B2
(45) Date of Patent: Aug. 29, 2006

(54) METHOD FOR OPERATING A COKE-OVEN BATTERY

(75) Inventors: Frank Krebber, Essen (DE); Helmut Dobert, Hattingen (DE); Ralf Schumacher, Hagen (DE); Ulrich Kochanski, Bochum (DE)

(73) Assignee: Uhde GmbH, Dortmund (DE)

( * ) Notice: Subject to any disclaimer, the term of this patent is extended or adjusted under 35 U.S.C. 154(b) by 338 days.

(21) Appl. No.: 10/469,902

(22) PCT Filed: Mar. 23, 2002

(86) PCT No.: PCT/EP02/03285

§ 371 (c)(1),
(2), (4) Date: Sep. 5, 2003

(87) PCT Pub. No.: WO02/094966

PCT Pub. Date: Nov. 28, 2002

(65) Prior Publication Data

US 2004/0084293 A1 May 6, 2004

(30) Foreign Application Priority Data

May 18, 2001 (DE) ..... 101 24 700
Jun. 15, 2001 (DE) ..... 101 28 99

(51) Int. Cl.
*C10B 27/06* (2006.01)
*C10B 47/00* (2006.01)

(52) U.S. Cl. ..... 201/35; 202/105; 202/256; 202/270; 137/14

(58) Field of Classification Search ..... 201/35; 202/105, 256, 270; 137/14
See application file for complete search history.

(56) References Cited

U.S. PATENT DOCUMENTS 4,168,208 A * 9/1979 Althoff et al. ..... 202/254
4,194,951 A * 3/1980 Pries ..... 202/227
4,306,939 A * 12/1981 Wackerbarth ..... 201/1
5,609,731 A * 3/1997 Giertz et al. ..... 201/35

FOREIGN PATENT DOCUMENTS

DE 44 24 874 1/1996
EP 0 649 455 4/1995
WO WO 94 01513 1/1994

OTHER PUBLICATIONS

Hofherr K et al: "Verbesserter umweltschutz durch moderne kokereitechnik am beispiel der neuen Schwelgern" Stahl Eisen; Stahl Und Eisen Mar. 15, 2001 Bd. 121, Nr.3,Seiten 33-40, XP002208014.

* cited by examiner

*Primary Examiner*—N. Bhat
(74) *Attorney, Agent, or Firm*—Collard & Roe, P.C.

(57) ABSTRACT

A method is provided for operating a coke oven battery including many identical coking chambers, a raw gas receiver, and throttle devices arranged in the receiver for individually controlling the gas pressure in the chambers. Each throttle device includes an immersion bucket acted upon by water. Gas lines terminating in immersion pipes in the immersion buckets connect the chambers with the receiver. Throttle devices are employed that include an overflow that can be vertically adjusted by an actuating drive for controlling the liquid level in the immersion bucket. For a coking chamber to which a pressure control device is allotted, the setting signals for the actuating drive allocated to the time pressure curve in the process of carbonizing coal to coke are recorded as a position-time curve. The actuating drives of throttle devices that are allocated to coking chambers without pressure control devices are controlled according to the position-time curve.

5 Claims, 4 Drawing Sheets

METHOD FOR OPERATING A COKE-OVEN BATTERY

CROSS REFERENCE TO RELATED APPLICATIONS

Applicants claim priority under 35 U.S.C. §119 of German Applications No. 101 24 700.1 filed on May 18, 2001 and 101 28 992.8 filed on Jun. 15, 2001. Applicants also claim priority under 35 U.S.C. §365 of PCT/EP02/03285 filed on Mar. 23, 2002. The international application under PCT article 21(2) was not published in English.

DESCRIPTION

The invention relates to a method for operating a coke oven battery comprising a large number of identical coking chambers; a raw gas receiver; and throttle devices arranged in the rude gas receiver for individually controlling the gas pressure in the coking chambers. Each throttle device has an immersion bucket that is impinged by water and has a drain that can be sealed. The coking chambers are connected with the crude gas receiver by gas lines that terminate in immersion pipes in the immersion buckets of the throttle devices.

Such throttle devices are known from EP 0 649 455 B1. By changing the level of the liquid in the immersion bucket, it is possible to control the gas pressure of the associated coking chamber depending on the release of the gas. The change in the level of the liquid in the immersion bucket is effected directly by controlling the in-feed of the water and the drain of the water. Water equilibrium conditions are adjusted in this connection that are dependent upon the static pressure of the water column in the immersion bucket, as well as on the clear cross section of the opening of the drain. These conditions change in the presence of variations in the amount of water being fed in or amount of water being drained. Each coking chamber of the coke oven battery requires a complicated control in order to fix the feed and drain of the water in the course of the coking process. All coking chambers have to be equipped in this connection with devices for measuring the chamber pressure. Furthermore, provision has to be made on the throttle devices for devices measuring and controlling the amount of throughflow both in the water in-feed and water drain. The expenditure for an automated operation is high in terms of control technology.

The invention is based on providing a method that permits a simple and safe operation of the coking chamber of a coke oven battery in terms of control technology.

It is assumed that the coke oven battery comprises a large number of coking chambers, a raw gas receiver, as well as throttle devices arranged in the raw gas receiver for individually controlling the gas pressure in the coking chambers, whereby the throttle devices each have an immersion bucket that is impinged by water and has a drain that can be sealed, and whereby the coking chambers are connected with the raw gas receiver by gas lines terminating in immersion pipes in the immersion buckets of the throttle devices. The object of the invention and the solution to the problem specified above is a method for operating such a coke oven battery with the following features:

1.1 Throttle devices are used that comprise an overflow that can be vertically adjusted for controlling the level of the liquid in the immersion bucket;

1.2 For a coking chamber to which a pressure control system is allocated that has a measuring device for measuring the chamber pressure, and which emits an actuating signal for controlling the actuating drive, the actuating signals allocated in the course of the carbonization process from coal to coke to the time pressure curve for the actuating drive are recorded in the form of a position-time curve;

1.3 the actuating drives of throttle devices allocated to the coking chambers without pressure controlling device are controlled according to the position-time curve.

The method as defined by the invention exploits the fact that the carbonization process in the coking chambers is a cyclic batch process, and that the development of gas in the course of the carbonization process has a predictable curve that is the same in all coking chambers. This makes it possible to control the level of the liquid in the immersion bucket according to a position-time curve that is filed in a process computer. The position-time curve is transmitted in this connection by the process computer in the form of actuating signals to the actuating drives of the throttle devices, which position the associated overflow in accordance with the actuating signals. According to the method as defined by the invention, it suffices if only one or a few more coking chambers of the coke oven battery are equipped with a pressure control device. The pressure control device is comprised of a measuring device for measuring the chamber pressure, and a position transmitter that generates based on the pressure values and nominal values actuating signals for the actuating drive of the vertically adjustable overflow. The transmitted setting signals filed for one or each gas development cycle in the form of a position-time curve and can be used during the next or later gas development cycles as setting signals instead of the setting signals received directly from the pressure control device. According to the invention, the position-time curve is employed also for operating coking chambers not equipped with any pressure control device.

According to a preferred embodiment of the invention, the pressure in the raw gas receiver is measured, and correction values are added to the functional values of the position-time curve if the pressure in the raw gas receiver is deviating from a reference value that has been measured during the recording of the position-time curve. Pressure variation occurring on the gas discharge side are compensated in this way, and have no adverse effect on the operation of the coking chambers. Interference quantities on the gas feed or gas generation side are known in the normal case and are caused by changes occurring in the operating parameters, for example when the coking times or the temperatures of the heating flue change. The position-time curve is newly recorded in such cases.

Further developments of the method as defined by the invention are the objects of the dependent claims 3 to 5 and are explained in the following with the help of a drawing showing only one exemplified embodiment. The following is schematically shown in the drawing:

BRIEF DESCRIPTION OF THE DRAWINGS

The invention relates to a method for operating a coke oven battery that is comprised of a large number of identical coking chambers, a raw gas receiver, and throttle devices for individually controlling the gas pressure in the coking chambers. FIGS. 1*a* and 1*b* show one of the coking chambers 1 with the associated throttle device, and a cutout from the raw gas receiver 2.

Figure 1A:
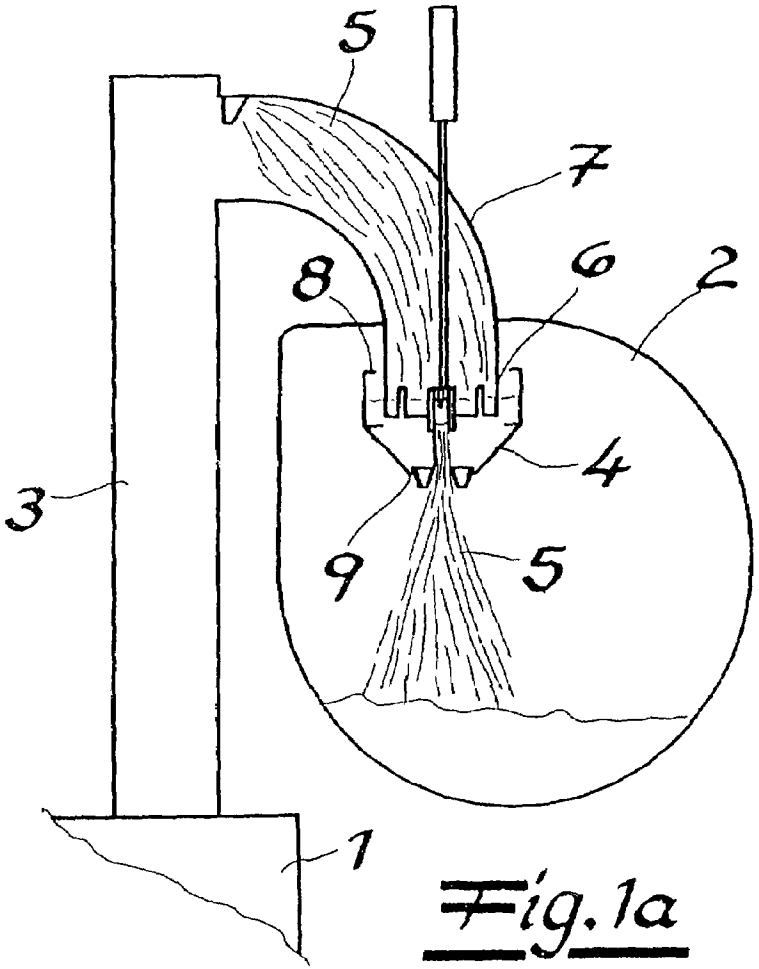
FIGS. 1*a* and 1*b* show a cutout of a coke oven battery with a throttle device arranged in the path of the gas between a coking chamber and a raw gas receiver, said throttle device being shown in different functional positions.
Figure 1B:
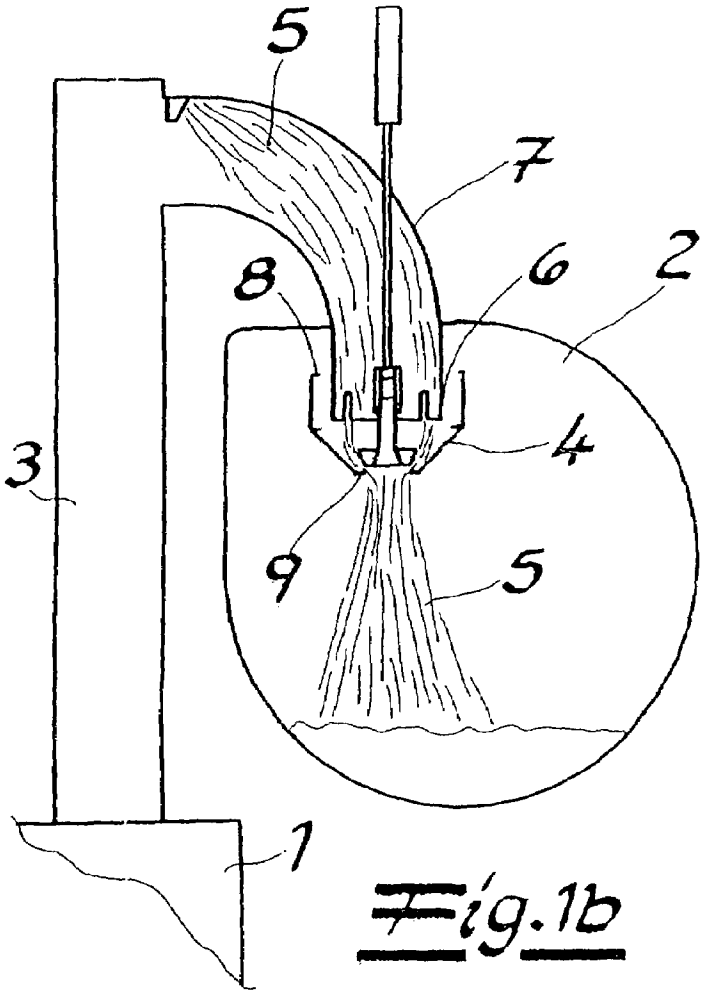
Figure 2:
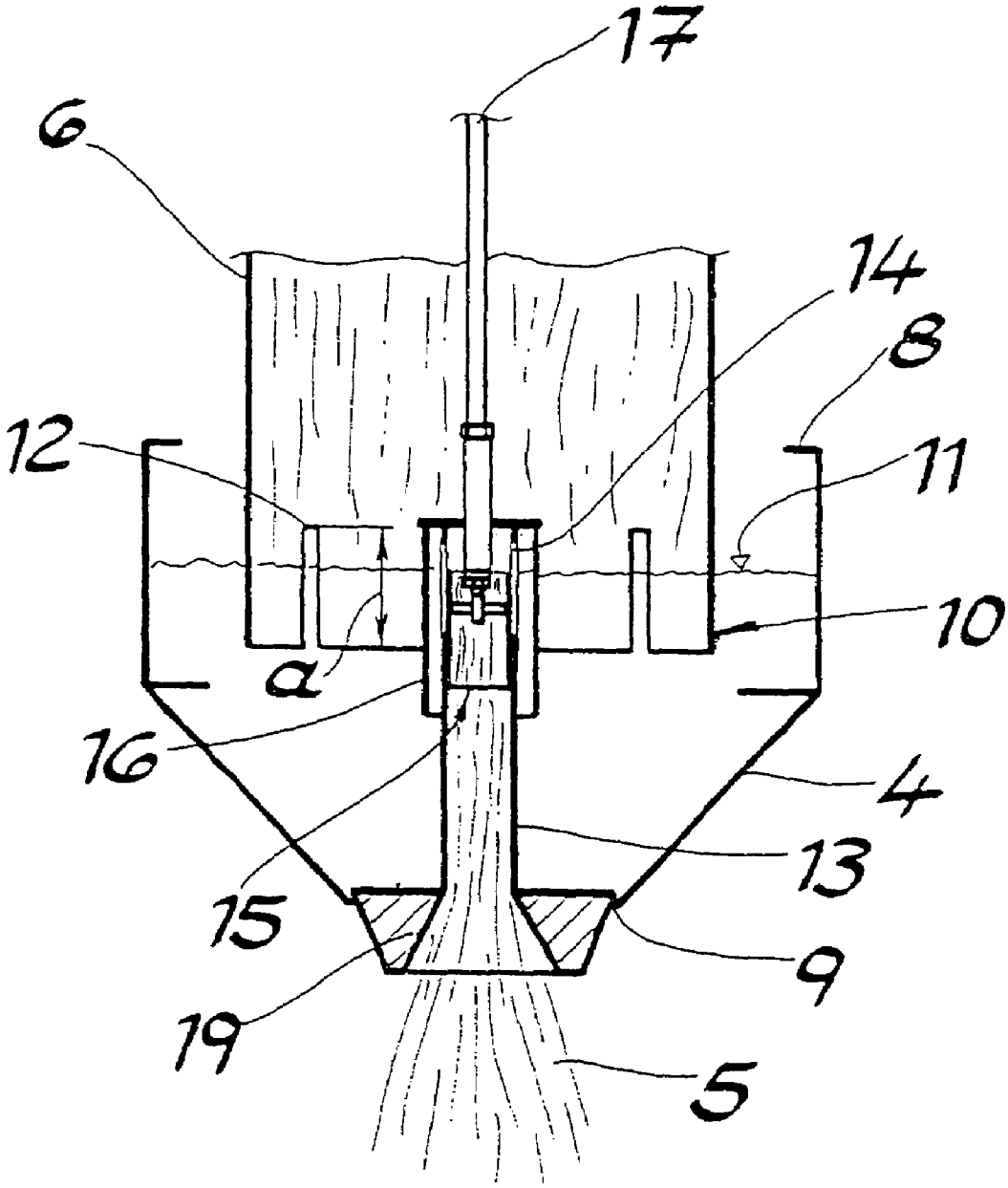
FIG. 2 shows a longitudinal section through the throttle device in an representation that has been enlarged vis-a-vis FIGS. 1*a* and 1*b*.

The throttle device is arranged within the raw gas receiver 2 of the coke oven battery and connected with the gas space of the coking chamber 1 via a riser pipe 3 (FIGS. 1*a*, 1*b*). The basic structure of the throttle device comprises an immersion bucket 4 that is continually supplied with the water 5, as well as an immersion pipe 6 that is connected with the riser pipe 3 and is terminated in the immersion bucket 4. The immersion bucket 4 comprises an overflow 8 as well as a drain 9 that can be sealed. The immersion pipe 6 is designed to have an end section 10; the clear gas outlet cross section of said end section is dependent upon the level 11 of the liquid in the immersion bucket 4. In the exemplified embodiment, the end section 10 has the slots 12 located on the side of the jacket (FIG. 2). Furthermore, the bottom edge may be profiled or beveled.

FIG. 2 shows that for controlling the level 11 of the liquid, provision is made for a drain pipe 13 for water. The end of said drain pipe on the inlet side protrudes into the immersion pipe 6 and contains the inlet openings 14 for the feed of water located on the jacket side. A slide 15 that is open at both face sides is arranged within the drain pipe 13. Said slide seals the inlet openings 14 of the drain pipe 13 according to its position in the longitudinal direction and is forming a vertically adjustable overflow for the water flowing into the drain pipe 13. The end of the drain pipe 13 located on the inlet side is surrounded by a siphon pipe 16, which closes the drain pipe 13 on the top side and is forming a ring channel for the in-feed of water, said ring channel feeding into the immersion bucket 4 below the immersion tube 6. The top edge of the slide 15 defines the height of the water level within the immersion bucket 4. In this connection, the siphon pipe 16 prevents gas from flowing through the drain pipe 13 and from negatively influencing the control of the water level.

The recesses 12 provided in the end section 10 of the immersion pipe 6 and located on the side of the jacket, which recesses may be designed, for example in the form of slots, are extending in the longitudinal direction across a section "a". The length of said section is adapted to the setting range of the slide 15 within the drain pipe 13.

The slide 15 can be driven by an actuating bar 17, which is guided through a section of the immersion pipe 6. Said actuating bar is extended outwards through the wall of the riser pipe elbow 7, whose extension represents the immersion pipe 6, and is connected there with a suitable actuating drive 18 (FIGS. 1*a*, 1*b*). It is useful if the actuating drive 18 is a driving aggregate that remain in the last control position in the event of any failure if its driving energy, because the last control position is the one at which the combination of water level and gas pressure conforms to a defined, safe condition. This is of importance mainly during the discharge of raw gas from the coking chamber for the reason that in the coking chamber, the pressure may neither excessively increase nor excessively drop there. In the event of any uncontrolled rise of the pressure, the risk exists that emissions may occur via the oven seals. In the event of any drop in the pressure, air may penetrate the coking chamber, which may lead to damages caused by overheating. The water level set last prior to a failure of the driving energy of the actuating drive 18, or any other interference acting on the actuating drive 18 represents at the same time the safe position for the operation of the oven under such a condition.

Figure 3:
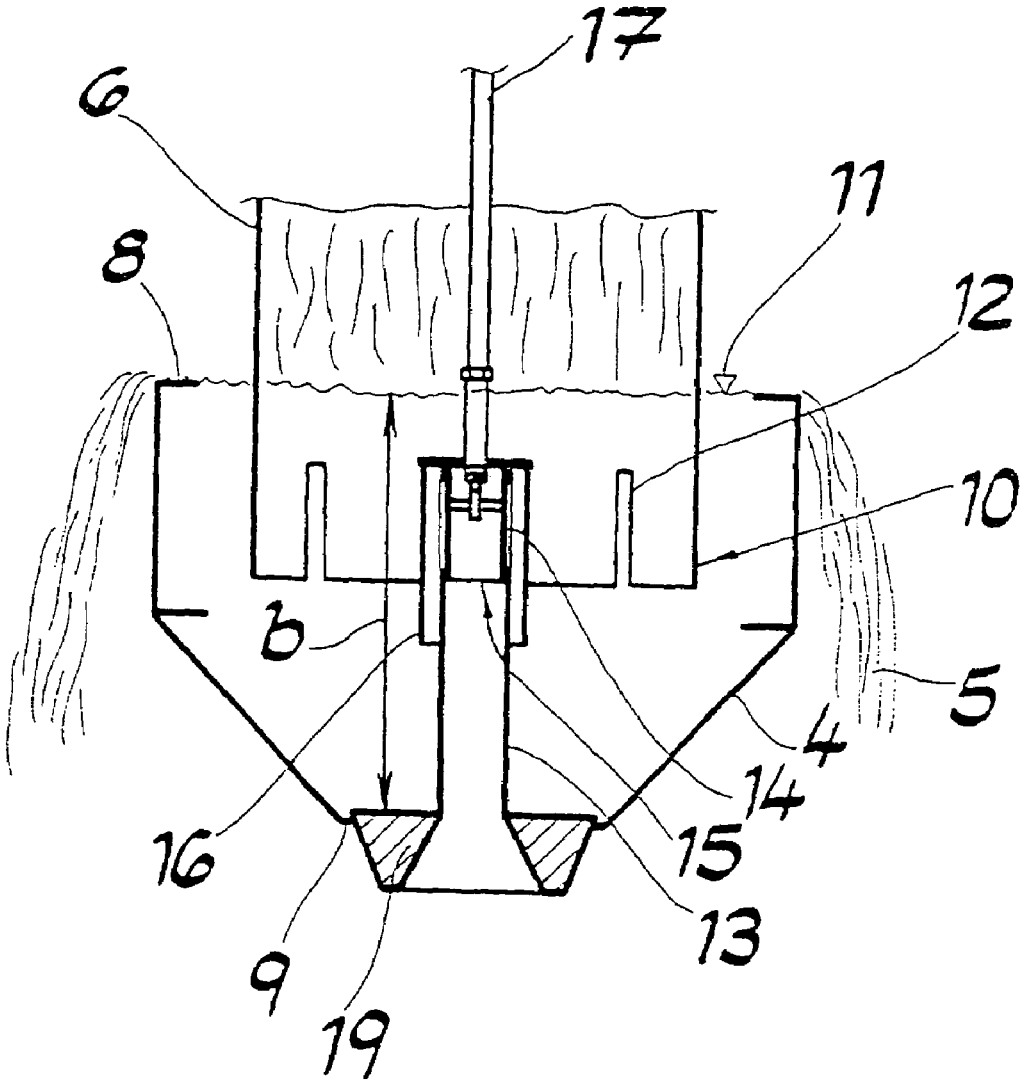
FIGS. 3 and 4 show other functional positions of the device shown in FIG. 2.

When the device is in the operating position shown in FIG. 3, the inlet openings 14 of the drain pipe 13 located on the side of the jacket, such inlet positions being designed, for example in the form of slots, are closed by the slide 15. The immersion bucket 4 is flooded by the water rushing in. The water is draining via the overflow 8 of the immersion bucket 4. The liquid column "b" in the immersion pipe 6 is adequately large for interrupting the path of the gas between the gas space of the coking chamber 1 and the raw gas receiver 2. The coking chamber 1 can be opened and fully refined coke can be pressed out. The device as defined by the invention prevents air from entering the raw gas receiver 2.

The drain pipe 13 is designed in the form of a movable setting element that is connected with a sealing stopper 19 associated with the drain 9, whereby the water draining in the drain pipe 13 is flowing off through a water duct in the sealing stopper 19 that is sealing the immersion bucket 4 (FIGS. 1*a* and 2). The sealing stopper 19 can be moved into the opening position shown in FIG. 4 by a lifting movement of the drain pipe 13 and releases the drain 9 of the immersion bucket 4 for emptying the immersion bucket. The device as defined by the invention assumes the operational position shown in FIG. 4 when the associated coking chamber. 1 is freshly refilled with coal. The filling gases are sucked without being throttled into the raw gas receiver 2 by means of the vacuum prevailing in the raw gas receiver 2.

Figure 4:
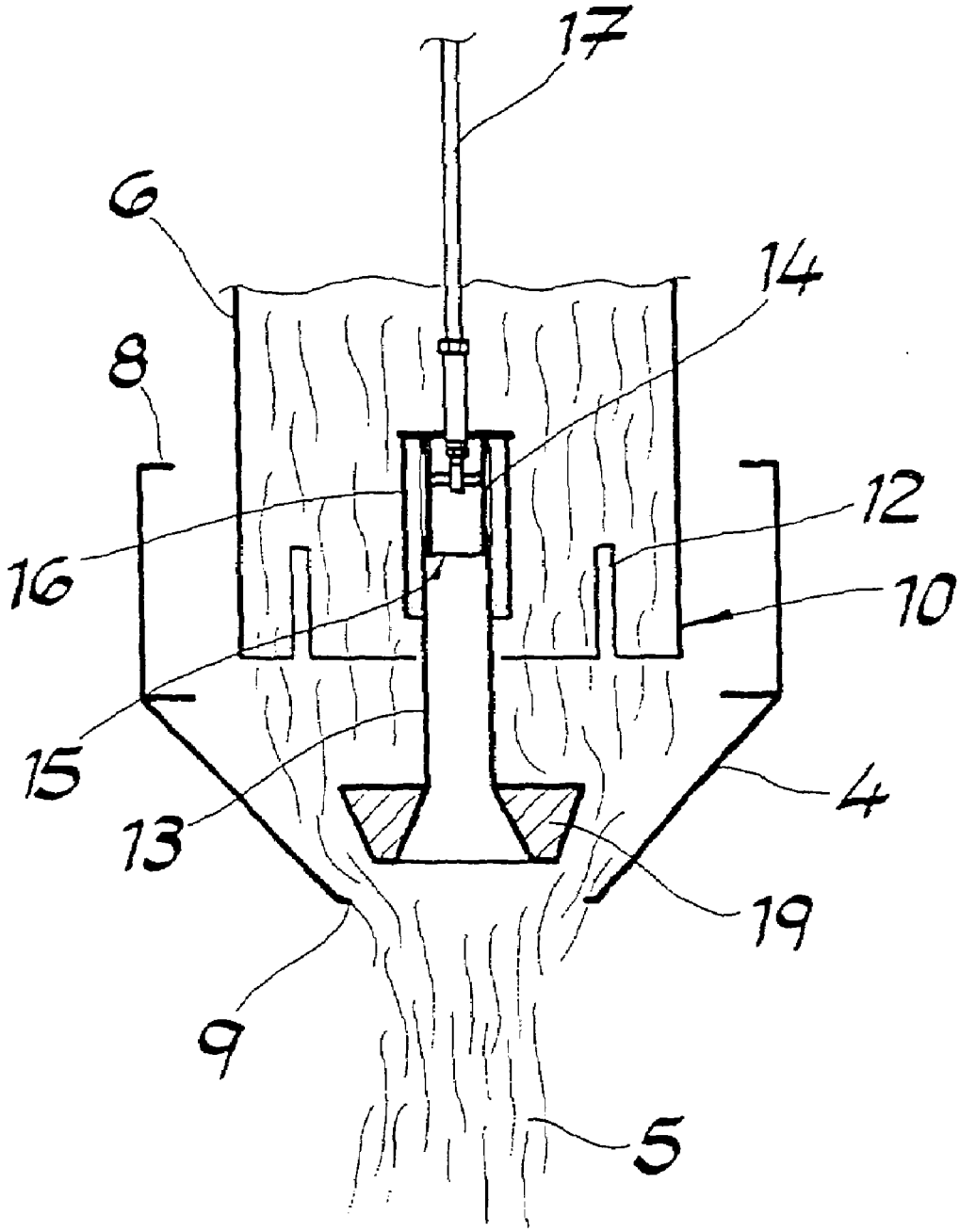

It is possible with the device as defined by the invention to control or regulate the complete operating cycle of a coking chamber. For charging the coking chamber 1 with coal, the immersion bucket 4 is completely drained so that the filling gases can be sucked without being throttled into the raw gas receiver 2 by means of the vacuum prevailing in the raw gas receiver 2. In the course of the carbonization time, the chamber pressure is controlled according to a preset value by regulating the level of the liquid in the device as defined by the invention. For pressing the fully refined coke out of the coking chamber 1, the path of the gas is interrupted by flooding the immersion bucket 4, so that no air can enter the raw gas receiver 2. A comparative look at the figures shows that the path of the gas is closed and opened by an equi-directional movement of the slider 15. The level of the liquid can be controlled by the setting movements of the slider 15 (FIG. 2). The inlet openings 14 of the drain pipe 13 can be sealed by a further setting movement of the slider (FIG. 3). The slider 15 can be driven against a stop, for example the top cover of the drain pipe 13, and during a further lifting movement of the drain pipe 13 drives the sealing stopper 19 along, the latter being connected in a fixed manner, whereby the drain 9 of the immersion bucket 4 is opened (FIG. 4). The required setting movements of the setting bar 17 are small as the sequence of the operational steps is taking place, so that the operational step can be carried out quickly.

In the operation of the coke oven battery as defined by the invention, to which a pressure control device with a measuring device for measuring the chamber pressure is allocated, and which comprises a position signal emitter for controlling the actuating drive, the setting signals for the actuating drive are recorded in the form of a position-and-time curve, namely for the entire carbonizaton process. The actuating drives for setting throttle devices, which are allocated to coking chambers that are not equipped with throttle device, are then controlled according to said position-and-time curve. In connection with the method as defined by the invention, it suffices if only one coking chamber or just a few coking chambers are equipped with a pressure control device. The throttledevices of the other coking chambers are controlled according to the recorded position-and-time curve that is applicable to all coking chambers. Pursuant to a further preferred implementation of the method as defined by the invention, the pressure in the raw gas receiver is measured, and correction values are added to the operational values of the position-and-time curve if the pressure in the raw gas receiver is deviating from a reference value that has been measured during the recording of the position-and-time curve.

Based on the knowledge of the position of the actuating drive and thus of the slider, a determination is made of the clear gas passage area of the slot-like recesses 12 located on the side of the jacket and in the end section 10 of the immersion pipe that is available above the level of the water. A theoretic volume of the stream of raw gas is computed based on such free gas passage area as well as on the pressure difference between the measured chamber pressure and the pressure measured in the receiver. This theoretic volume of the stream of gas is stored in the form of a collated, standardized curve over the entire refining time. For controlling the chamber pressure over the refining time during a later refining operation, or on another oven, the clear gas passage area of the slot-like recesses 12 located in the end section 10 of the immersion pipe on the jacket side required for adjusting the nominal chamber pressure, is computed with the help of the stored time curve of the volume of the stream of raw gas, as well as based on the pressure difference between the preset chamber pressure (nominal value) and the pressure measured in the receiver. Based on this value, the position of the slider or the actuating drive is determined by direct allocation, and that position is then adjusted. In connection with the described procedure, the time curve for the (theoretic) volume of the stream of raw gas does not reflect the actual volume of the stream of raw gas over the refining time, but rather reflects a standardized value that has been adjusted by the difference between the pressure in the chamber and the pressure in the receiver. Said adjusted value is applicable to the position of the drive or the slide.

Pressure variations on the side of the gas discharge are compensated by the procedure described above. Interference quantities on the gas feed or gas generation side are known in the normal case and predominantly occur only if changes are made in connection with the operating parameters, for example changes of the refining time or of the temperature of the heating flue. Such changes can be taken into account by re-acquiring the position-and-time curve for controlling the actuating drives at regular intervals, at least, however, when serious changes of the operating parameters are made.

The invention claimed is:

1. A method for operating a coke oven battery comprising a large number of identical coking chambers, a raw gas receiver, and throttle devices arranged in the raw gas receiver for individually controlling the gas pressure in the coking chambers, whereby the throttle devices each comprise an immersion bucket acted upon by water and having a sealable drain, and whereby the coking chambers are connected with the raw gas receiver by gas lines terminating in immersion pipes in the immersion buckets of the throttle devices, wherein:

(a) the throttle devices comprise an overflow vertically adjustable by an actuating drive for controlling the level of the liquid in the immersion bucket;

(b) for a coking chamber to which a measuring device for measuring the chamber pressure with a position signal transmitter is allocated for controlling the actuating drive, the actuating signals allocated to the time pressure curve during the carbonization from coal to coke are recorded for the actuating drive in the form of a position-time curve; and (c) actuating drives are controlled by throttle devices according to the position-time curve, said throttle devices being allocated to coking chambers without pressure control devices.

2. The method according to claim 1, characterized in that the pressure in the raw gas receiver is measured; and that correction values are added to the operational values of the position-time curve if the pressure in the raw gas receiver deviates from a reference value measured during the recording of the position-time curve.

3. The method according to claim 1, characterized in that after the carbonization process in a coking chamber, the vertically adjustable overflow allocated to such coking chamber is sealed and the immersion bucket is flooded with water up to an overflow before the coke is pressed out of the coking chamber.

4. The method according to claim 2, characterized in that before a coking chamber is charged with coal, the immersion bucket of the associated throttle device is drained in order to suck off the emission occurring during the charging process free of throttling by means of the vacuum prevailing in the raw gas receiver.

5. The method according to claim 1, characterized in that a slider located in a drain pipe and open on both face sides is actuated by the actuating drive, said slider sealing on the side of the jacket inlet openings of the drain pipe protruding into the immersion pipe according to its position in the longitudinal direction, and forming the overflow;

whereby the end of the drain pipe located on the inlet side is sealed by a siphon pipe sealing the drain pipe at the top side and forming a ring channel for the water in-feed, said ring channel feeding below the immersion pipe into the immersion bucket; and whereby the drain pipe is a movable setting element connected to a sealing stopper associated with the drain of the immersion bucket, and the water draining from the drain pipe is flowing off through a water duct in the sealing stopper sealing the immersion bucket;

and that during the lifting movements of the slider, the level of the liquid in the immersion bucket is controlled in the course of the carbonization process, and the inlet openings are closed upon completion of the carbonization process, and the sealing stopper is subsequently opened in order to drain the immersion bucket before the coking chamber is filled with fresh coal.

* * * * *

UNITED STATES PATENT AND TRADEMARK OFFICE

CERTIFICATE OF CORRECTION

PATENT NO. : 7,097,743 B2
APPLICATION NO. : 10/469902
DATED : August 29, 2006
INVENTOR(S) : Krebber et al.

It is certified that error appears in the above-identified patent and that said Letters Patent is hereby corrected as shown below:

In particular, on the cover page, column 1, item [30], please correct the number of the second-cited Foreign Patent of the Claim of Priority of the Foreign Application Priority data from "DE……...101 28 99" to correctly read:
-- DE……..101 28 992.8--.

Signed and Sealed this

Sixth Day of March, 2007

JON W. DUDAS
*Director of the United States Patent and Trademark Office*